United States Patent [19]

Lozon

[11] Patent Number: 4,679,481

[45] Date of Patent: Jul. 14, 1987

[54] SOUND ENHANCING DEVICE

[76] Inventor: Richard Lozon, 14952 Stoneham, Riverview, Mich. 48192

[21] Appl. No.: 853,664

[22] Filed: Apr. 18, 1986

[51] Int. Cl.[4] ..... G10D 3/04

[52] U.S. Cl. ..... 84/309; 84/274

[58] Field of Search ..... 84/274–275, 84/277, 298–299, 307, 309

[56] References Cited

U.S. PATENT DOCUMENTS

| | | | |
|---|---|---|---|
| 388,883 | 9/1888 | Kopp | 84/309 |
| 2,103,675 | 12/1937 | Johannessen | 84/309 |
| 2,786,382 | 3/1957 | Melita | 84/298 |

*Primary Examiner*—Lawrence R. Franklin

*Attorney, Agent, or Firm*—Cullen, Sloman, Cantor, Grauer, Scott & Rutherford

[57] ABSTRACT

A sound enhancing device including a bridge pad of a cold flowable material fitted to support the full underside of a bridge foot on a stringed musical instrument is disclosed. The bridge pad is positioned between the feet of the bridge and the body portion of the musical instrument whereby the tension of the strings causes the pad to cold flow to conform to the contours of the body portion and the bottom of the bridge feet, whereby the string vibrations will be transmitted to the body portion of the stringed musical instrument with greater clarity, tone and richness of the sound of the musical instrument. The pads are pre-cut to fit directly between the bridge feet and the body portion of the instrument.

10 Claims, 3 Drawing Figures

SOUND ENHANCING DEVICE

FIELD OF THE INVENTION

The present invention relates generally to stringed musical instruments and particularly to a sound enhancing device for such instruments, one aspect of which is that it improves the mating relationship of the bridge to the body portion of the stringed musical instrument to improve the tone, clarity and richness of the sound.

BACKGROUND OF THE INVENTION

Stringed musical instruments such as a violin, viola, cello, guitar, and bass, currently utilize strings located in parallel succession extending from the scroll of the instrument, which is located at the end of the neck and attaching across the top of the instrument, to the tail piece located at the bottom of the instrument. The bridge consists of a wood device machined or fitted to predetermined dimensions. The bridge is located to fit on the top of the body portion of the instrument between the neck and the tail piece, its purpose being to lift the strings up off of the top of the body portion of the instrument, allowing their tension to be adjusted and transmitting the musical vibrations of the strings to the body of the instrument through the feet of the bridge.

The bridge is attached or fitted to the instrument where the feet of the bridge contact the top of the body portion of the instrument. The bridge is held firmly in place through the tension of the strings exerting downward pressure on the bridge. Because the top of the body portion of the instrument is a compound curved surface, the bridge feet must be fitted accurately to the top in order to efficiently transmit the string vibrations to the body portion of the instrument and thereby produce musical tones.

The conventional method for machining the bridge feet in order to mate them with the top of the instrument is a process of hand sanding the bridge feet. This is accomplished by attaching a small pad of sandpaper to the top of the body portion of the instrument where the bridge is to be located and moving the bridge feet over the sandpaper until the bridge feet are sanded into the same shape as the body. The drawback of this method is that hand sanding makes for an irregular and non-uniform fit due to the humans's inability to maintain a constant and even pressure while sanding. This problem is exaggerated by the inability to precisely measure and eliminate microscopic gaps between the bridge feet and the top of the instrument. The microscopic gaps in the seating of the bridge feet to the surface of the instrument impedes the transmission of the strings vibrations to the top of the body portion of the instrument thereby reducing the instrument's ability to create and produce precise or accurate musical tones. However, instruments in use today do produce aesthetically appealing musical tones, but could be more appealing to the trained ear.

Further, stringed instruments in use today do not provide a method of adjusting the location of the bridge feet laterally and longitudinally on the body of the instrument. Additionally, current state of the art instruments, after replacement or adjustment of the bridge, experience days to weeks of "play in" time during which the newly adjusted or fitted bridge naturally as a result of the tension of the strings, develops a more conductive fit with the body of the instrument. Also, under the current state of the art, changes in weather or temperature cause microscopic changes in the shape and contour of a stringed instrument, and the microscopic changes affect the mating relationship between the bridge feet and the body of the instrument.

Thus, there is a need for the sound enhancing device of the present invention which provides for an improved stringed instrument which is more appealing to the trained ear. In addition to improving the tone and timbre of the instrument, the present invention also provides other functional purposes, for example, a method of adjusting the location of the bridge laterally and longitudinally on the body of the instrument by which the play in time may be reduced significantly, possibly as much as 95%. Similarly, use of the present invention causes stringed instruments to adjust more quickly to climatic changes and changes in temperature. Thus, as a result of the conductive properties of the invention, these climatic and temperature changes do not affect the mating relationship between the bridge feet and the body of the instrument. In addition, the present invention provides automatic adjustment to the microscopic changes in the shape and contour of the stringed instrument caused by the changes in temperature and weather.

SUMMARY OF THE INVENTION

As recognized in the art, the purpose of a bridge on a stringed instrument, including a violin, viola, cello, guitar, and bass, is to lift the strings off of the body of the instrument, allow for an adjustment of their tension, and to primarily transmit the vibrations of the strings to the top of the body portion of the instrument. The more precisely fitted the bridge is to the top of the instrument, the more efficiently and completely the string vibrations will be transmitted to the body and the greater the clarity, tone, and richness of the musical instrument's sound. The sound enhancing device of the present invention accomplishes a perfect seat of the bridge to the top of the instrument by placement of a bridge pad of a cold flowable material between the feet of the bridge and the top of the stringed instrument. A perfect seat is achieved through the elastic "Cold Flow" properties of the bridge pad which allow it to conform and distort precisely to the irregular surfaces of the top of the stringed instrument and the bottom of the bridge feet.

The sound enhancing device of the present invention, for a stringed musical instrument having a body portion and a plurality of strings running transversely to the axis of the stringed musical instrument along its top under tension, includes a bridge. The bridge is located between the strings and the body portion of the stringed musical instrument. A bridge pad of cold flowable material is situated between the bridge and the body portion of the stringed musical instrument for enhancing the mating relationship of the bridge to the body portion of a stringed musical instrument. Thus, when the strings are under tension, the bridge pad, as a result of the tension, cold flows to conform and distort to the contacting surfaces of the body portion of the stringed muscial instrument and the bridge so that the string vibrations will be transmitted through the bridge to the body portion of the stringed musical instrument with clarity, tone and richness of the sound of the stringed musical instrument.

In addition, the bridge pad of the present invention, for a stringed musical instrument having a body portion and a plurality of strings under tension whereby the mating relationship of a bridge situated between the strings and the body portion of the stringed musical instrument is enhanced, includes a cold flowable material. The material is cut and dimensioned such as to fit between the bridge and the body portion of the stringed musical instrument. Thus, when the strings are under tension, the material will cold flow to conform to the contours of the body portion to enhance the mating relationship between the bridge and the body portion of the stringed musical instrument so that the string vibrations will be transmitted through the bridge to the body portion of the stringed musical instrument.

The method, of the present invention, for enhancing the mating relationship of a bridge to a body portion of a stringed musical instrument includes loosening the strings. This is to reduce the tension on the bridge situated between the strings and the body portion of the stringed musical instrument. Then, inserting at least one pad of a cold flowable material between the bridge and the body portion of the stringed musical instrument, and tightening the strings. Thus, as a result of the tightening of the strings, the material of the pad cold flows to conform to an outer surface of the body portion so that the string vibrations will be transmitted through the bridge to the body portion of the stringed musical instrument.

BRIEF DESCRIPTION OF THE DRAWINGS

The various, features, objects, benefits and advantages of the present invention will become more apparent by reading the following detailed description in conjunction with the drawings where like reference numerals identify corresponding components, and.

DETAILED DESCRIPTION OF THE PREFERRED EMBODIMENT

Figure 1:
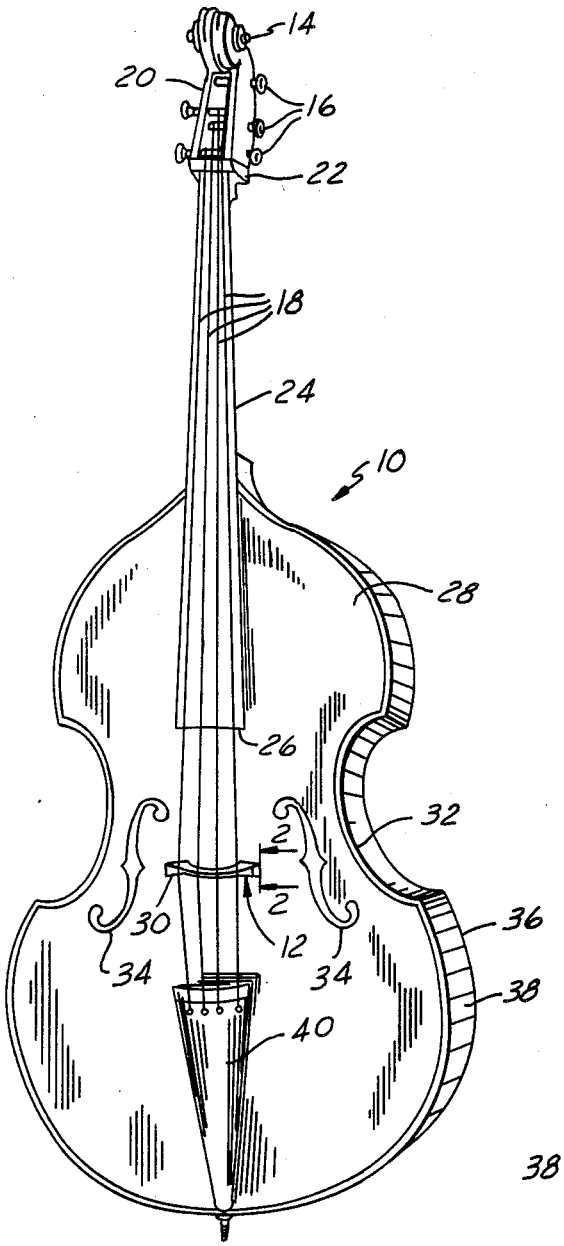
FIG. 1 is a full frontal view of a stringed musical instrument, such as a viola, violin, cello, guitar, or bass, utilizing the sound enhancing device of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device and any further applications of the principle of the invention as illustrated therein being contemplated as would normally occur to one skilled in the art to which the invention relates.

Referring to FIG. 1, there is illustrated a stringed musical instrument 10 such as a violin, viola, cello, or bass, all being identical in shape but merely different in size and minor design detail, utilizing the sound enhancing device 12 of the present invention. The instrument 10 includes a scroll 14, pegs 16 to which the strings 18 are attached, and a peg machine 20 which operates to hold the pegs 16 in place. A saddle 22 serves to connect the peg machine 20 to a neck 24. A fingerboard 26 extends up from the top 28 of the instrument 10 to the neck 24, ultimately connecting with the saddle 22. A bridge 30 is located on the top 28 of a body portion 32 of the instrument 10 perpendicular to the longitudinal axis of the instrument and a pair of F holes 34. The top 28 is connected to the bottom 36 of the instrument by the side 38. A tail piece 40 is connected to the top 28 of the instrument and serves to connect the strings 18 of the instrument at its bottom.

Figure 2:
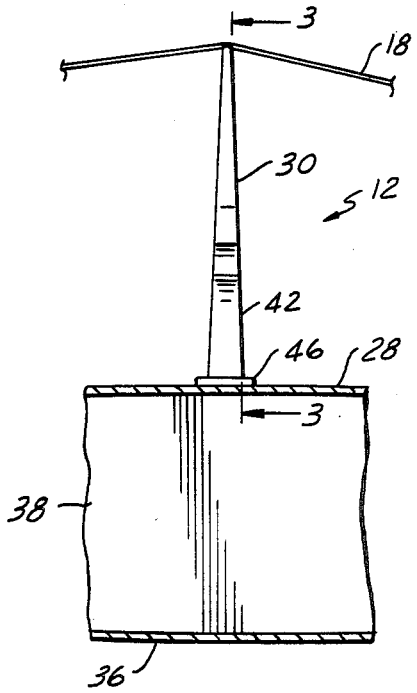
FIG. 2 is an enlarged, fragmentary, transverse view illustrating the sound enhancing device of the present invention, partly in section, taken in the direction to arrows 2—2 of FIG. 1.
Figure 3:
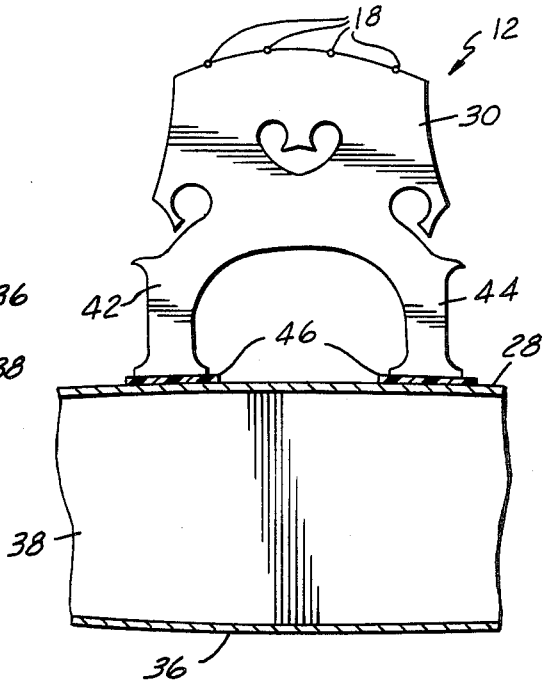
FIG. 3 is an enlarged, fragmentary, longitudinal view of the sound enhancing device of the present invention, partly in section, taken in the direction of arrows 3—3 of FIG. 2.

As illustrated in FIG. 1 and in greater detail in FIGS. 2 and 3, the sound enhancing device 12 includes the bridge 30 with the currently standard number of bridge feet 42 and 44. A bridge pad 46 is located between each of the bridge feet 42 and 44 and the top 28 of the instrument 10. The bridge 30, bridge feet 42, 44, bridge pad 46 and top 28 of the instrument 10 are depicted upon installation of the sound enhancing device 12. The bridge feet 42 and 44 mate with the bridge pad 46, with the bridge pad located between the bridge feet and the top 28 of the instrument. Thus, upon installation of the sound enhancing device 12, the strings 18 apply pressure to the bridge 30, bridge feet 42, 44, bridge pad 46, and the top 28 of the instrument.

The bridge pad 46 is preferably a cold flowable material such as a plastic or polymeric material. Suitable commercially available cold flowable materials include synthetic resin polymers and products, for example a polyfluoroethylene such as Teflon ("TEFLON" is a trademark of E. I. DuPont deNemours & Company of Wilmington, Del.) which is cold flowable and has a low coefficient of friction. Such a material may be compressed and cold flow upon tightening of the strings 18 of the instrument 10, which allows it to conform and distort precisely to the irregular surface of the top 28 of the stringed musical instrument 10 and the bottom of the bridge feet 42 and 44. Thus, as a result of the tension of the strings, the pads 46 develop a more conductive fit to enhance the mating relationship with the body portion 32 of the instrument 10 and feet 42 and 44 of the bridge 30. In addition, because such a material has a low coefficient of friction, it provides for ease of adjusting the location of the sound enhancing device 12 laterally and longitudinally on the body portion 32 of the instrument 10 without requiring the loosening of the strings 18.

What is claimed is:

1. A sound enhancing device for a stringed musical instrument having a body portion and a plurality of strings running transversely to the axis of the stringed musical instrument along its top under tension, comprising:

a bridge being located between the strings and body portion of the stringed musical instrument; and a bridge pad of a cold flowable material being situated between the bridge and the body portion of the stringed musical instrument for enhancing the mating relationship of the bridge to the body portion of the stringed musical instrument, whereby when the strings are under tension the bridge pad, as a result of the tension, cold flows to conform and distort to the contacting surfaces of the body portion of the stringed musical instrument and the bridge so that the string vibrations will be transmitted through the bridge to the body portion of the stringed musical instrument with clarity, tone and richness of the sound of the stringed musical instrument.

2. The sound enhancing device defined in claim 1, wherein the bridge has two feet and a pad of cold flowable material is located between each foot and the body portion of the stringed instrument.

3. The sound enhancing device defined in claim 1, wherein the cold flowable material has a low coefficient of friction associated therewith so that the location of the bridge while under tension may be adjusted laterally and longitudinally on the body portion of the stringed instrument.

4. The sound enhancing device defined in claim 1, wherein the bridge pad is situated between the bridge and the body portion of the stringed instrument so that clarity, tone and richness of the sound of the musical instrument is improved.

5. The sound enhancing device defined in claim 1, wherein the thickness of the pad may be varied to adjust the height of the bridge.

6. The sound enhancing device defined in claim 1, wherein said cold flowable material is a polymeric material.

7. The sound enhancing device defined in claim 6, wherein the cold flowable polymeric material is Teflon.

8. A method for enhancing the mating relationship of a bridge to a body portion of a stringed musical instrument, comprising the following steps:

loosening the strings of the stringed musical instrument to reduce the tension on the bridge situated between the strings and the body portion of the stringed musical instrument;

inserting at least one pad of a cold flowable material betweem the bridge and the body portion of the stringed musical instrument; and tightening the strings of the stringed musical instrument as a result of which the material of the pad cold flows to conform to an outer surface of the body portion so that the string vibrations will be transmitted to the body portion of the stringed musical instrument.

9. The method defined in claim 8, wherein the bridge has two feet and a pad is inserted between each foot and the body portion of the stringed musical instrument.

10. The method defined in claim 8, further comprising the step of adjusting the position of the bridge where the cold flowable material has a low coefficient of friction.

* * * * *